US006199698B1

(12) United States Patent
Hetrick et al.

(10) Patent No.: US 6,199,698 B1
(45) Date of Patent: Mar. 13, 2001

(54) PHARMACEUTICAL PACKAGING WITH SEPARATION MEANS

(75) Inventors: Haydee Hetrick, Shelbyville; Olivier Y. Muggli, Louisville, both of KY (US)

(73) Assignee: Alusuisse Technology & Management, Ltd., Neuhausen am Rheinfall (CH)

( * ) Notice: Subject to any disclaimer, the term of this patent is extended or adjusted under 35 U.S.C. 154(b) by 0 days.

(21) Appl. No.: 09/453,506

(22) Filed: Dec. 3, 1999

(51) Int. Cl.[7] ..... B65D 83/04

(52) U.S. Cl. ..... 206/532; 206/484; 206/524.2; 383/211

(58) Field of Search ..... 206/530, 532, 206/484, 524.2, 459.5, 469; 428/34.3, 35.2; 383/210, 211

(56) References Cited

U.S. PATENT DOCUMENTS

| | | | | |
|---|---|---|---|---|
| 2,760,630 | * | 8/1956 | Lakso | 206/532 X |
| 3,503,493 | * | 3/1970 | Nagy . | |
| 3,750,907 | * | 8/1973 | Steele | 206/524.2 X |
| 3,872,970 | * | 3/1975 | Edison | 206/532 |
| 4,011,949 | * | 3/1977 | Braber et al. | 206/532 |
| 4,279,344 | * | 7/1981 | Holloway, Jr. | 383/210 X |
| 4,303,750 | * | 12/1981 | Campbell et al. | 206/524.2 X |
| 4,303,751 | * | 12/1981 | Campbell et al. | 206/524.2 X |
| 5,253,754 | * | 10/1993 | Soodak | 383/210 X |
| 5,511,665 | * | 4/1996 | Dressel et al. | 206/532 |
| 5,837,336 | * | 11/1998 | Ichimura et al. | 383/211 X |
| 6,003,670 | * | 12/1999 | Beer | 206/459.5 |
| 6,066,404 | * | 5/2000 | Suzuura et al. | 206/484 X |

FOREIGN PATENT DOCUMENTS

| | | | | |
|---|---|---|---|---|
| 1141810 | * | 2/1969 | (GB) | 206/484 |
| 112641 | * | 12/1944 | (SE) | 206/484 |

* cited by examiner

*Primary Examiner*—Bryon P. Gehman
(74) *Attorney, Agent, or Firm*—Fisher, Christen & Sabol

(57) ABSTRACT

A pouch for a pharmaceutical, cosmetic, medical or similar product, with a structure having a top laminate and a bottom laminate. A pouch enclosure for the product is formed in one portion of the structure. The top laminate and the bottom laminate of the pouch enclosure portion are strongly adhered together in the periphery around the pouch enclosure. A flap portion is formed by the remainder of the structure with a portion of the involved region of the top laminate and a portion of the involved region of the bottom laminate are weakly adhered together and are easily pulled apart. Arrangement for separating the flap portion and the pouch enclosure is situated at the interface between the flap portion and the pouch enclosure portion. A notch or slot is located in the strongly adhered periphery of the pouch enclosure portion adjacent to the flap portion. The flap portion is larger than the pouch enclosure portion. Both sides of the top laminate and of the bottom laminate are capable of being printed on.

20 Claims, 11 Drawing Sheets

FIG. 1
PRIOR ART
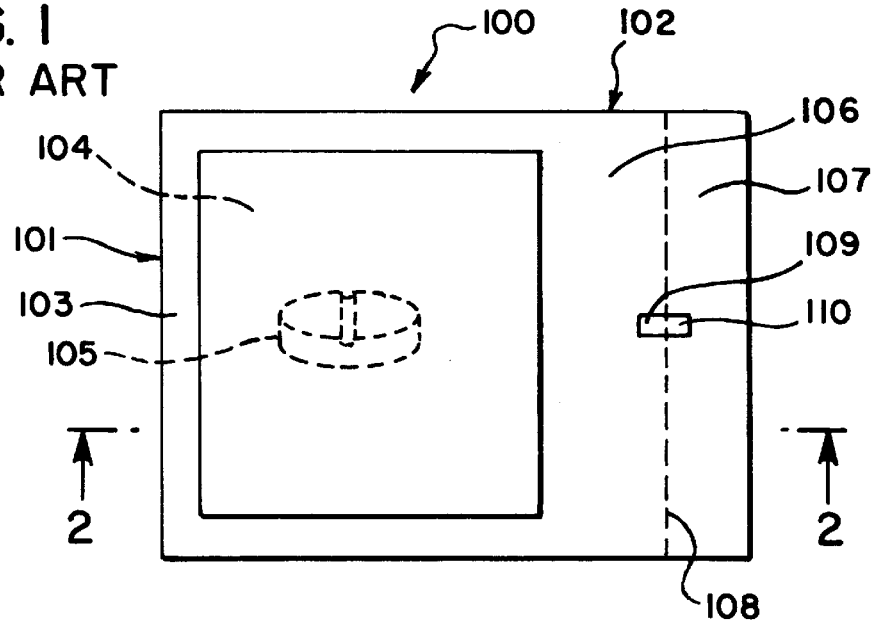
FIG. 2
PRIOR ART
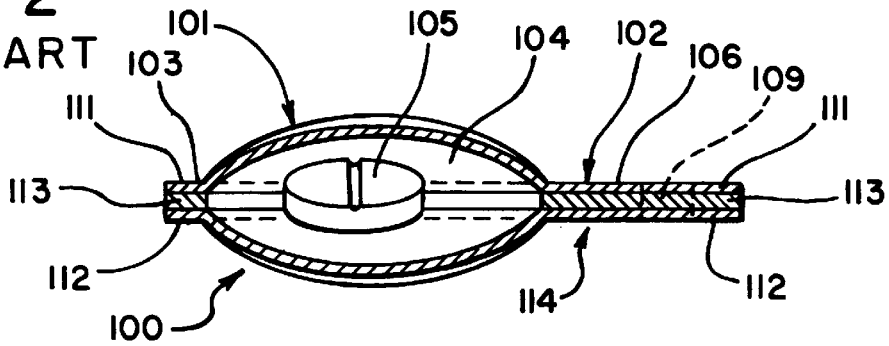
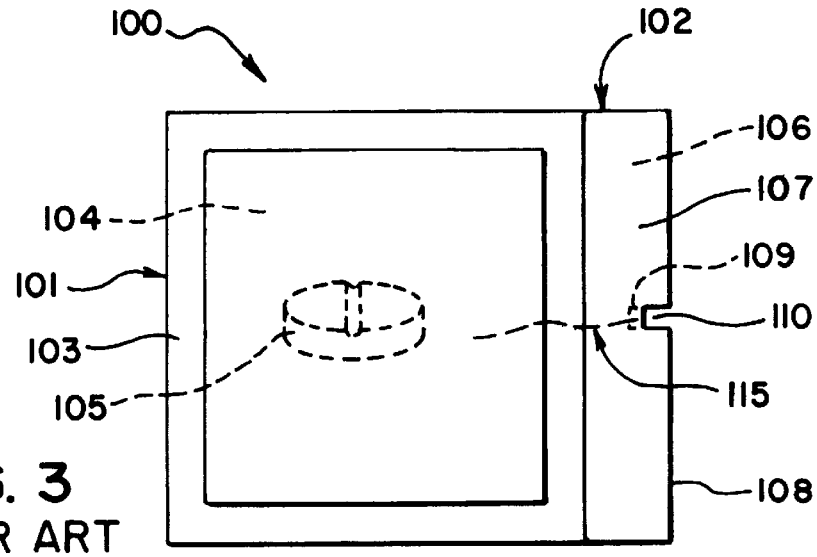
FIG. 3
PRIOR ART

PHARMACEUTICAL PACKAGING WITH SEPARATION MEANS

BACKGROUND OF THE INVENTION

1. Field of the Invention

The invention relates to improved packaging, more specifically improved pouches, for pharmaceutical, cosmetic and medical products.

2. Background Art

Currently, pouches on the market for pharmaceutical, cosmetic and medical products are constituted by a front and a back material sealed firmly together all around the perimeter of the pouch. The pouches are made out of laminates known to the art as laminates of metal foils and polymeric films, typically decorated with printing on one or both visible sides of the pouch.

Typical pouch laminate constructions are laminates of polyester films adhering to a metal foil, such as, an aluminum foil, adhering to a sealant layer, typically made out of a polyolefinic material, such as, polyethylene, polypropylene or copolymers thereof.

The polyester film is typically printed on one side. The printing may be buried between the polyester film and the adhesive, known as reverse printing, or may be on the surface of the polyester and exposed to the outside environment, known as surface printing. In many situations the surface printing would require an overlacquer, also known as an overprint varnish, to protect the ink from flaking or scuffing when exposed to the rigors or packaging lines, shipping stresses and consumer misuse.

The pouch constructions, as known in the art, are made out of multiple layers put together with an adhesive. The adhesive may be, although not necessarily, a urethane base or a polyolefinic type like polyethylene and its copolymers. The selection of the layers and the adhesive to adhere the layers together or the heat seal coatings to effect the seals, depend upon the product to be packaged, conditions of use, storage conditions and the barrier requirements needed to protect the product. Moisture, oxygen, light and sometimes other gases can be detrimental to the packaged product, and a protection to such environmental effects is required. In such applications, a metal foil as barrier is often used. In some applications, such barrier is not required, and more cost-effective structures can be used successfully. Such structures would, for instance, be constituted of biaxially oriented polypropylene with a polyolefinic sealant layer, such as, polyethylene, or a laminate of paper and a polymeric sealant could also be used.

The pouch embodiment is fabricated by welding the sealant layer together, thereby constituting an enclosed pocket containing the goods to be packaged. See FIG. 1.

In certain pharmaceutical applications, such pouch laminate is realized so that the tear resistance of the material is high enough to prevent children from tearing them, and are thereby considered child-resistant. A typical mode of opening for adults is realized by providing the pouch with a notch in the seal area, this notch not extending to the extremity of the pouch. The sealed area needs to be folded over the notch and the pouch torn from the notch in the direction of said notch to tear the pouch open. See FIGS. 2 and 3. This sequence of movements is not achievable by children of age less than 51 months and, therefore, the pouch is considered child-resistant.

In the case of pouches used for pharmaceutical products, the United States Food and Drug Administration, as well as similar administrations in other countries, require that each unit or single dose have a complete disclosure of the product content, dosage, side-effects, etc., thereby constantly increasing the surface required to print such vast information with font size readily legible by consumers. Therefore, the pharmaceutical industry and consumers are afflicted by increasing costs of packaging, as the size of these packages increase simply to allow for sufficient print area.

BROAD DESCRIPTION OF THE INVENTION

An object of the invention is to provide improved child-resistant pouches for pharmaceutical, medical, cosmetic and similar products, which provide large surfaces for printing information on without extension of the size of the pouches. Other objects and advantages of the invention are set out herein or are obvious herefrom to those skilled in the art.

The objects and advantages of the invention are achieved by the improved pouches of the invention.

The invention involves a pouch for a pharmaceutical, cosmetic, medical or similar product. The pouch has a structure with a top laminate and a bottom laminate. A pouch enclosure for the product is formed in one portion of the structure. The top laminate and the bottom laminate of the pouch enclosure portion are strongly adhered together in the periphery around the pouch enclosure. A flap portion is formed by the remainder of the structure with a portion of the involved region of the top laminate and a portion of the involved region of the bottom laminate are weakly adhered together and are easily pulled apart. Means for separating the flap portion and the pouch enclosure portion is situated at the interface between the flap portion and the pouch enclosure portion. A notch or slot is located in the strongly adhered periphery of the pouch enclosure portion adjacent to the flap portion. The flap portion is larger than the pouch enclosure portion. Both sides of the top laminate and of the bottom laminate are capable of being printed on. For example, printing can be visibly contained on the inside and outside surfaces of both of the top laminate region and the bottom laminate region of the flap portion.

The invention can also increase the available outer surface for printing on by reducing the size of the pouch enclosure (as compared to the prior art pouch enclosures). In view of this approach, the outer surface area of the flap portion of the invention pouch can be increased up to 50 percent or more.

The invention pouches have the purpose to keep the packaging costs contained within the current situation, thus increasing the total printing surface significantly without increasing the cost of packaging nor adding a secondary package.

Other solutions to achieve the benefit of larger print surfaces are costly, as they involve as discussed above either a bigger package or by adding flaps to packages, including inserts or booklets or by adding expanded-content labels. These add-ons are invariably a source of increased raw material costs and process costs.

The invention achieves such increase in printing surface without adding material and process costs while still providing a child-resistant package.

The main benefit of the pouches of the invention is that it increases the area available for printing information without adding more materials. It takes a current pouch, such as, a sample unit dose pouch or sachet, reduces the size of the cavity while keeping the length and width as originally specified. The balance of the material is used for the information printing on both surfaces, front and back.

When the top and bottom laminate regions of the flap portion have been separated from each other, the top and bottom laminate regions can each individually be easily separated from the pouch enclosure portion.

The means for separating the flap portion from the pouch enclosure portion preferably is a line of perforations aligned along the intersection of the flap portion and the pouch enclosure portion. Preferably a notch or slot is located on each end of the line of perforations and aligned on the longitudinal axis of the line of perforations.

The means for separating the flap portion from the pouch enclosure portion can also be a groove located in the top surface of the top laminate and/or the bottom laminate and aligned along the intersection of the flap portion and the pouch enclosure portion. Preferably a notch or slot is located on each end of the groove line and aligned on the longitudinal axis of the groove or grooves.

The longitudinal axis of the notch or slot in the strongly adhered periphery of the pouch enclosure portion is aligned between 45 and 90 degrees, preferably between 75 and 90 degrees, most preferably 90 degrees, to the intersection between the pouch enclosure portion and the flap portion. In other words, the longitudinal axis of the notch or slot being perpendicular to the intersection between the pouch enclosure portion and the flap portion provides the best results regarding safety and opening of the pouch. The notch or slot in the strongly adhered periphery of the pouch enclosure portion preferably does not contact the line of perforations, and preferably is located far enough away from the line of perforations, so that the notch or slot does not tear when the top and/or bottom laminates of the flap portion are removed from the pouch enclosure portion.

Preferably the periphery of the pouch enclosure portion adjacent to the flap portion is wider (e.g., 20 to 100 percent, preferably 50 percent) than the other parts of the periphery.

The invention pouch:

provides increased printing area contains the cost of packaging materials maintains current process efficiencies and configurations (no add-ons, such as, additional labels, flaps, inserts, booklets, leaflets and expanded-content labels, etc.)

achieves child resistance uses conventional structures uses conventional processes.

The invention pouch:

is a new combination of conventional art to achieve the above benefits is a new pouch design or configuration with easy access to additional printed user and/or marketing information has new child resistant feature with perforations to prevent accidental or incidental access to the product improves senior friendliness with a larger area to grab to perform the required fold over and opening at the notch improves child resistance for the same reason as above, because the area is too big for children's hands and the notch is away from the edge of the pouch, where children typically bite or tear shows tampering with the pouch when the pouch has been handled and the "flap(s)" are missing like when children have tried to open it.

In a preferred embodiment of the pouch of the invention, the top laminate contains, from the outer surface to the inner surface thereof, respectively:

(a) an overprint varnish layer, (b) a first ink printed layer, (c) a polyester (preferably polyethylene terephthalate) layer or a paper layer, (d) a first adhesive layer, (e) a metal (preferably aluminum) foil, (f) a second adhesive layer, (g) a polyolefin (preferably low density polyethylene) layer, (h) a second ink printed layer, (i) a strongly adhered heat seal adhesive layer in the pouch enclosure portion, and a cold seal adhesive layer or a pressure sensitive adhesive layer or a peelable sealing adhesive layer or a weak heat sealable adhesive layer in the flap portion, and the bottom laminate contains, from the outer surface to the inner surface thereof, respectively:

(j) an overprint varnish layer, (k) a first ink printed layer, (l) a polyester (preferably polyethylene terephthalate) layer or a paper layer, (m) a first adhesive layer, (n) a metal (preferably aluminum) foil, (o) a second adhesive layer, (p) a polyolefin (preferably low density polyethylene) layer, (q) a second ink printed layer.

In another preferred embodiment of the pouch of the invention, the top laminate contains, from the outer surface to the inner surface thereof, respectively:

(a) an overprint varnish layer, (b) a first ink printed layer, (c) a paper layer, (d) an adhesive layer, (e) a Ceramis® polyester (preferably polyethylene terephthalate) layer, (f) a second ink printed layer, (g) a strongly adhered heat seal adhesive layer in the pouch enclosure portion, and a cold seal adhesive layer or a pressure sensitive adhesive layer or a peelable sealing adhesive layer or a weakly adhered heat sealable adhesive layer in the flap portion, and the bottom laminate contains, from the outer surface to the inner surface thereof, respectively:

(h) an overprint varnish layer, (i) a first printed layer, (j) a paper layer, (k) an adhesive layer, (l) a Ceramis® polyester (preferably polyethylene terephthalate) layer, (m) a second ink printed layer.

Ceramis® is a trademark for a silicon oxide coated polyester or polyolefin or polyamide film. The trademark Ceramis® is owned by algroup, a corporation of Switzerland, which has a principal place of business in Zurich, Switzerland. In the invention, the preferred Ceramis® is the silicon oxide coated polyester film, most preferably the silicon oxide coated polyethylene terephthalate film, but the polyolefin and polyamide versions can be used. The preferred polyamide version is the silicon oxide coated nylon film. The preferred polyolefin version is the silicon oxide coated polyethylene film (more preferably high density polyethylene), although good results can also be obtained with silicon oxide coated polypropylene film.

In a further preferred embodiment of the pouch of the invention, the top laminate is transparent and contains, from the outer surface to the inner surface thereof, respectively:

(a) an overprint varnish layer, (b) a first ink printed layer, (c) a polyester (preferably polyethylene terephthalate) layer, (d) an adhesive layer, (e) a Ceramis® polyester (preferably polyethylene terephthalate) layer, (f) a second ink printed layer, (g) a strongly adhered heat seal adhesive layer in the pouch enclosure portion, and a weakly adhered sealable adhesive layer in the flap portion, and the bottom laminate contains, from the outer surface to the inner surface thereof, respectively:

(h) an overprint varnish layer, (i) a first ink printed layer, (j) a polyester (preferably polyethylene terephthalate) layer, (k) an adhesive layer, (l) a Ceramis® polyester (preferably polyethylene terephthalate) layer, (m) a second ink printed layer.

In another preferred embodiment of the pouch of the invention, the top laminate is opaque and contains, from the outer surface to the inner surface thereof, respectively, (a) an overprint varnish layer, (b) a first ink printed layer, (c) a paper layer, (d) an adhesive layer, (e) preferably a Ceramis® polyester (preferably polyethylene terephthalate) layer, or a metallized (preferably Al) polyethylene layer or preferably a metallized (preferably Al) polyester (preferably polyethylene terephthalate) layer, (f) a second ink printed layer, (g) a strongly adhered heat seal adhesive layer in the pouch enclosure portion, and a weakly adhered sealable adhesive layer in the flap portion, and the bottom laminate contains, from the outer surface to the inner surface thereof, respectively:

(h) an overprint varnish layer, (i) a first ink printed layer, (j) a paper layer, (k) an adhesive layer, (l) preferably a Ceramis® polyester (preferably polyethylene terephthalate) layer, or a metallized (preferably Al) polyethylene layer or preferably a metallized (preferably Al) polyester (preferably polyethylene terephthalate) layer, (m) a second ink printed layer.

A particularly preferred embodiment of the pouch of the invention has a structure composed of:

(a) a pouch enclosure portion comprising a top laminate and a bottom laminate, the periphery of pouch portion (a) comprising the periphery of the top laminate and the periphery of the bottom laminate being strongly adhered together by means of a heat sealed adhesive layer, at least one of the center region of the top laminate extended and the center region of the bottom laminate being outwardly extended, thereby forming a pouch enclosure wherein the product is contained; and (b) a flap portion which is contiguous with pouch portion (a), flap portion (b) comprising a contiguous extension of the top laminate and a contiguous extension of the bottom laminate, which are weakly adhered together over a portion of inner surfaces of the contiguous extensions of the top and bottom laminates by means of a peelable adhesive coating, a pressure sensitive coating material, a cold seal adhesive coating, or a weak heat sealable adhesive coating, a line of perforations being aligned along the intersection between the pouch enclosure portion and the flap portion, a notch or slot being located on each end of the line on the longitudinal axis of the line of perforations, a further notch or slot being located in the strongly adhered periphery of the pouch enclosure portion adjacent to the flap portion, the further notch or slot being aligned perpendicular to the line of perforations and not contacting the line of perforations.

BRIEF DESCRIPTION OF THE DRAWINGS

In the drawings:

FIG. 1 is a top view of a prior art pouch for pharmaceutical, medical or cosmetic products;

FIG. 2 is a cross-sectional side view along line 2—2 of the prior art pouch of FIG. 1;

FIG. 3 is a top view of the prior art pouch of FIG. 1 with the wide side area folded over on the notch therein to allow opening;

DETAILED DESCRIPTION OF THE INVENTION

Figure 4:
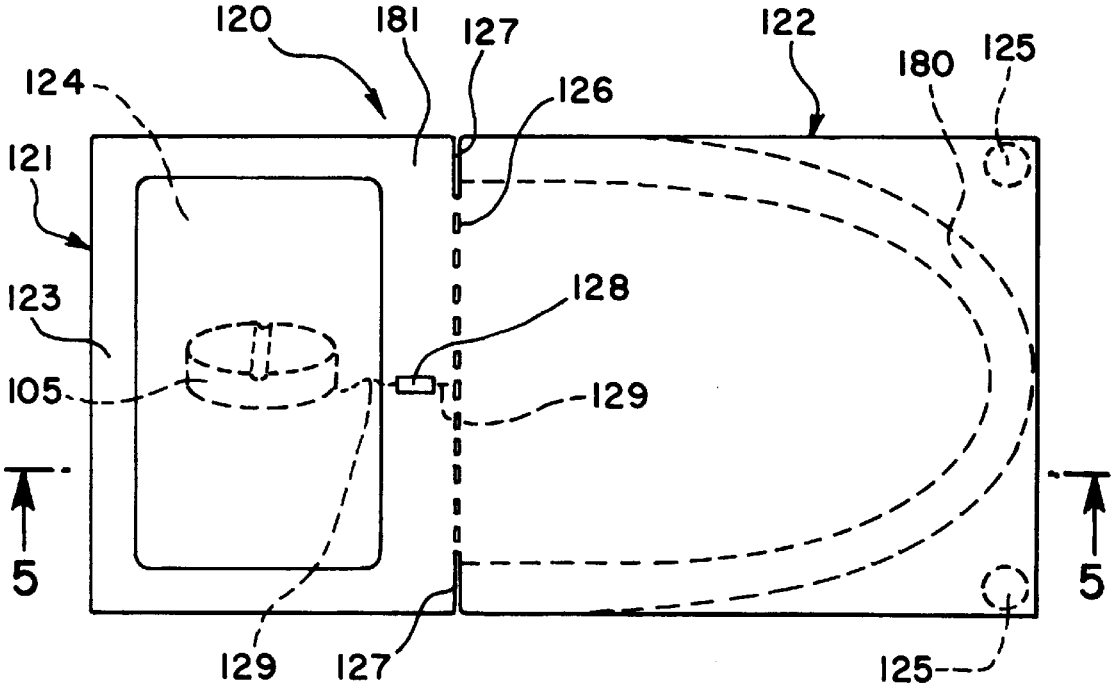
FIG. 4 is a top view of a preferred embodiment of the invention pouch for pharmaceutical, medical or cosmetic products.

As used herein, strongly adhered together means that it is difficult to pull apart the top and bottom laminates. As used herein, weakly adhered together means that it is easy to pull apart the top and bottom laminates.

In FIG. 1, prior art pouch 100 has pouch enclosure portion 101 and extended portion 102, both of which are formed by contiguous composite 114. Composite 114, as shown in FIG. 2, has top laminate 111 and bottom laminate 112 which are strongly, tightly adhered (welded) together by heat sealable adhesive layer 113. Bubble enclosure portion 104 contains tablet 105. Periphery 103 around bubble enclosure portion 104 is tightly, strongly heat sealed by means of heat sealable adhesive layer 113. As shown in FIG. 2, the internal portions of the expanded portions of top laminate 111 and bottom laminate 112 which form bubble enclosure 104 do not have any heat sealable adhesive 113, but could readily contain heat sealable adhesive layer 113 on the internal surface of either or both of top laminate 111 and bottom laminate 112. This is a matter of choice of design and production. Side periphery portion 106 is wider than the other three side portions of periphery 103 and forms web 114. The parts of top laminate 111 and bottom laminate 112 which form web 114 are strongly, tightly adhered together by heat sealable adhesive layer 113. Both external surfaces of web 114 (i.e., the outer surfaces of top laminate 111 and bottom laminate 112) provide areas which can be printed upon. Web 114 can be much wider (not shown) and thereby forming more extensive external surfaces upon which printing can be placed, but the cost of the prior art pouch is accordingly increased.

Notch 109 is somewhat centrally located in web 114, as shown in FIG. 1. Fold line 108 in web 114 is parallel to the adjacent side of pouch enclosure 104 and traverses through notch 109 (forming outer portion 110 of notch 109). The longitudinal axis of notch 109 is perpendicular to fold line 108 and the adjacent side of pouch enclosure 104. As shown in FIG. 3, web 114 is folded over along fold line 108. In this manner, notch 109 is also folded over thereby forming a notch 109/110 in the folded over edge of web 106. Exposed notch 109/110 can then be used to tear folded-over web 106 and the areas of top laminate 111 and bottom laminate 112 to expose tablet 105 (see typical tear line 115).

Figure 5:
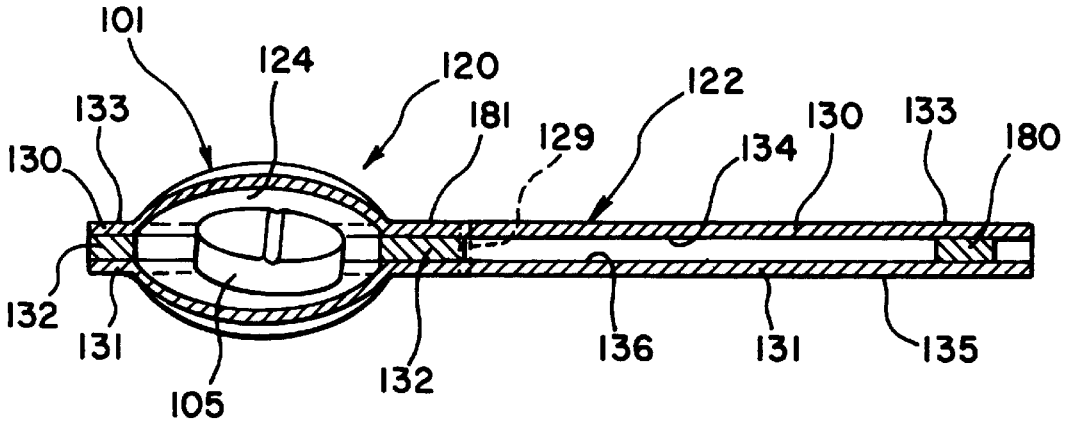
FIG. 5 is a cross-sectional side view along line 5—5 of the invention pouch of FIG. 4.
Figure 6:
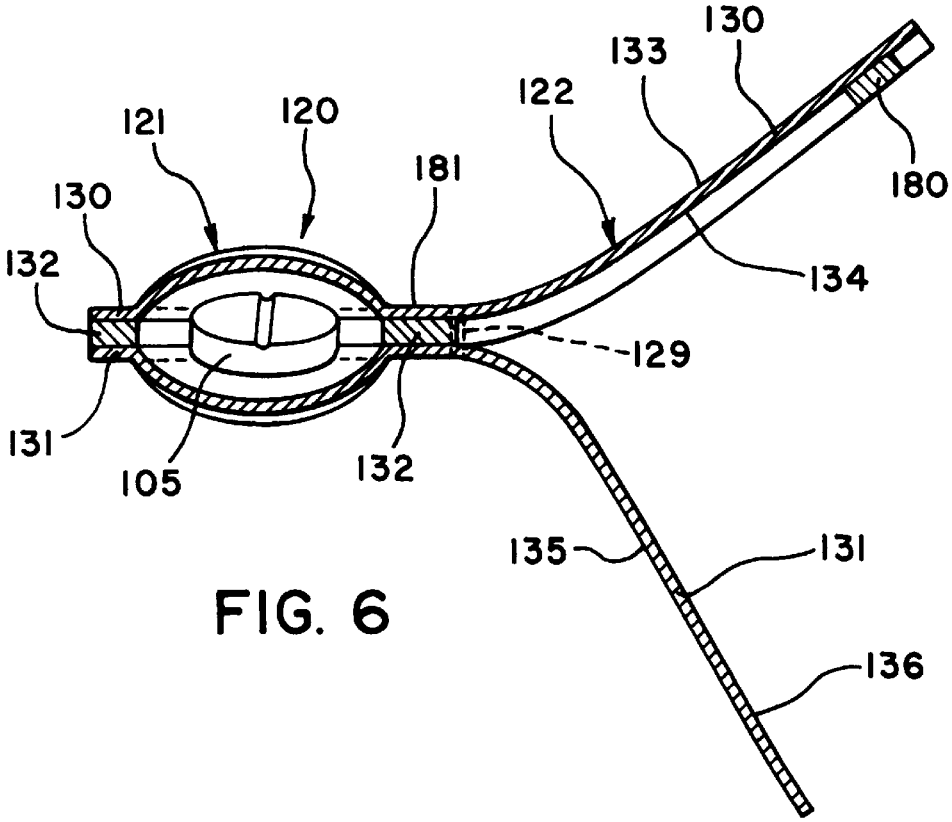
FIG. 6 is a cross-sectional side view along line 5—5 of the invention pouch of FIG. 4 with the top and bottom laminates of the flap portion in expanded position.

A preferred embodiment of the pouch of the invention is shown in FIGS. 4 to 6. Pouch 120 has pouch enclosure portion 121 and extended portion 122 (flap portion 122). As shown in FIG. 5, top laminate 130 and bottom laminate 131 are contiguous. Bubble enclosure portion 124 contains tablet 105. Periphery 123 around bubble enclosure portion 124 is tightly, strongly heat sealed (welded) by means of heat sealable layer 132. As shown in FIG. 5, the internal surfaces of the expanded portions of top laminate 130 and bottom laminate 131 which form bubble enclosure 124 do not have any heat sealable adhesive 132, but could readily contain heat sealable adhesive layer 132 on either or both of the internal surfaces of top laminate 130 and bottom laminate 131. This is a matter of choice of design and production. Side periphery portion 181 is wider than the other three side portions of periphery 123. Line 126 of perforations is situated at the interface of flap portion 122 and pouch enclosure portion 121. Notch or slot 127 is located at each end of line 126 of perforations. Notch or slot 128, located in periphery 123, is aligned perpendicular to line 126 of perforations and does not contact line 126 of perforations.

Top laminate 130 and adhesive layer 132/180 (125) preferably are one of composites 133 of FIGS. 8, 10, 12, 14 and 16. Bottom laminate 131 preferably is one of composites 135 of FIGS. 9, 11, 13, 15 and 17.

The parts of top laminate 130 and bottom laminate 131 are tightly sealed together by adhesive layer 132. The inner and outer surfaces of top laminate 130 and bottom laminate 131 provide extensive areas which can be printed upon. Flap portion 122 can be half of the size of web 114 of prior art pouch 100 in FIG. 2 and still have the same amount of surface for printing on. When flap portion 122 is the same size as web 114 of prior art pouch 100, flap portion 122 has twice as much surface area for printing on. The invention includes decreasing the size of the pouch enclosure 124, as compared to prior art pouch enclosure 104, whereby flap portion 122 is larger than web 114 of prior art pouch 100 and flap portion 122 has more than twice as much surface area for printing on.

In flap portion 122, top laminate 130 and bottom laminate 131 are weakly sealed together preferably in a pattern which only covers a minor portion of the inner surface of top laminate 130 and/or bottom laminate 131 (when top laminate 130 and bottom laminate 131 are separated) so as not to substantially reduce the surface areas of the inner surfaces of top laminate 130 and bottom laminate 131 which can contain printing. Adhesive layer 125/180 can extend over all or part of the inner surfaces of top laminate 130 and bottom laminate 131. (All of part of adhesive layer 125/180 can be attached to top laminate 130 and bottom laminate 131 during formation of pouch 120 or when top laminate 130 and bottom laminate 131 are separated.) The most preferred pattern for adhesive layer 125/180 is shown in FIG. 4, namely, adhesive layer 180 has an arc shape with the open side facing line 126 of perforations, and adhesive layer 125 in spot (circular) shape in the outer corners of flap portion 122. Adhesive layer 125/180 is preferably a peelable adhesive coating, a pressure sensitive coating, a cold seal adhesive coating or a weak heat sealable adhesive coating.

As shown in FIG. 6, top laminate 130 (with lightly sealed adhesive layer 125/180) and bottom laminate 131 portions of flap portion 122 can be easily separated so as to expose the printing on the inner surfaces of top laminate 130 and bottom laminate 131. If adhesive layer 125/180 is one which is resealable, top laminate 130 and bottom laminate 131 can be resealed. Top laminate 130 and/or bottom laminate 131 parts of flap portion 122 can be separated from pouch enclosure portion 121 along line 126 of perforations.

When flap portion 122 (or top laminate 130 or bottom laminate 131) is connected to pouch enclosure 121, notch or slot 128 is not exposed so as to provide easy tearing open of pouch 120. If flap portion 122 (or top laminate 130 or bottom laminate 131) is folded over along line 126 of perforations, notch or slot 128 is exposed so as to allow pouch 120 to easily be torn open. When flap portion 122 is separated from pouch enclosure portion 121, notch or slot 128 can be used to assist in tearing across side periphery portion 181 and the areas of top laminate 130 and bottom laminate 131 to expose tablet 105 (see typical tear line 129) by folding side periphery 181 over so as to expose notch or slot 128 to an edge. As notch or slot 128 does not contact line 126 of perforations, such factor makes it difficult for an infant/young child to accidentally open pouch 120.

Figure 7:
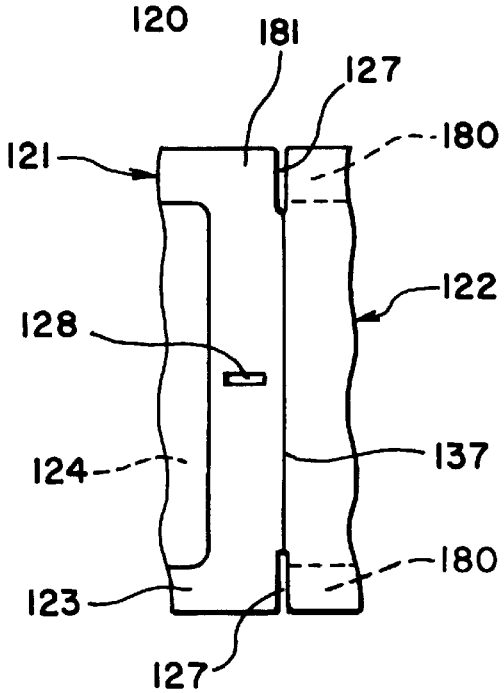
FIG. 7 is a partial top view of another embodiment of the invention pouch.

FIG. 7 shows the use of groove 137 (one or both sides of pouch 120) in place of line 126 of perforations.

When inspecting current pouches used in pharmaceutical applications and if such pouch is a primary package for such pharmaceutical product, it is evident that the size and surface of the pouch is defined, not necessarily by the size of the product to be packaged (example: a small tablet of 3×10 mm is packaged in a pouch of 45×70 mm), by the amount of information legally required for a single product unit.

The invention, preferably makes use of simple laminates as primary packaging, which as material combinations known to people skilled in such art. These structures are, for instance, polyester film laminated to Ceramis®, i.e., a silicon oxide coated polyester film; or a paper layer of conventional weight of 30 to 50 gr./$m^2$ laminated to a silicon oxide coated polyester film or to a metallized polyester film; a polyester film laminated to a metal foil such as aluminum in the thickness of 6 to 12 microns and laminated to a polyolefin, like polyethylene. The heat seal coatings are commonly known compounds such as formulations of ethylene vinyl acetate applied wet and dried on a printing press dryer. Such simple laminates are very cost effective and can be mass-produced inexpensively.

The invention also encompasses more complex laminates/composites.

The polyolefins for the laminates are, for example, polyethylene, polypropylene and copolymers thereof, with low density polyethylene usually preferred. The adhesives are, for example, a urethane base or a polyolefinic type like polyethylene and copolymers thereof.

The laminates used in the invention pouches can be made by conventional lamination processes and equipment. The lamination process can be described as bonding together of two or three materials to form a multi-ply structure and is referred to as a duplex or triplex lamination, respectively. A triplex (film/foil/film) lamination process is described, as follows. Three materials, i.e., foil, film A and film B, are fed into the process from unwind stands. The lamination of the foil to film A begins as a coating process. A solvent-based adhesive coating is applied to one side of the foil. The adhesive is then dried through a multiple zone dryer producing a dry tacky film and is conveyed to a lamination station situated at the end of the drying tunnel. Film A, which has been delivered to the lamination station via a separate unwind and web path, is mated to the adhesive coated foil. The two materials are bonded together as they pass through a heated pressure nip formed by a chromed steel heated laminating roll and rubber coated backing roll. Temperature and pressure provide the necessary driving forces to achieve bonding. The laminating station is comprised of one heated laminating roll with a pressure roll and two chill rolls. The chill rolls cool the laminate to stabilize the web and make it easier to handle. This process is repeated as film B is laminated to the other side of the foil. This process, described as dry bond lamination, is performed as one continuous operation at speeds typically exceeding 100/m min.

The above and other laminated structures for the invention pouches described herein may be produced by other lamination processes, such as, extrusion lamination and coating, and heat laminations.

The laminates are then printed on both sides in register, i.e., the print information on one side of the laminate is synchronized with the other printed side. This process is known as two-sided print, and can be achieved at high speed and at low cost.

In addition to the print, but in register, a layer of sealable coating may be applied, as well as a layer of either cold sealable material or a heat sealable layer that has a lower seal strength than such sealable layer, are applied on the same side of the laminate. The other side of the laminate, which is also printed, is covered with a so-called heat resistant overlacquer or overprint varnish such as nitrocellulose or polyester base overlacquers, as is known in the art.

The finished laminate is thereby printed on both sides with pertinent regulatory and marketing information. One side of such laminate is covered with a heat resistant and/or a release overlacquer to protect the ink during the subsequent heat seal process or to keep it from sticking to the cold seal or other sealable coating. The other side of the laminate is also printed, but covered with two different heat sealable coatings, or one heat sealable and one cold-sealable coating over the printed information. Such heat seal coating(s) preferably is transparent, and therefore does not alter the appearance of the print.

The most preferred configurations are described on FIGS. 8 to 13 which make use of tightly and partly sealed options, and FIGS. 14 to 17 which create a different performance by a differential in heat seal coating or heat seal layer.

The pouch assembly is performed on conventional pouching equipment, requiring only minor tool modification from a conventional pouch-sealing machine.

There are different processes leading to a sealed conventional pouch. There are so-called rotary sealing machines, vertical form-fill and seal equipment, all leading to three-sided or four-sided sealed pouches, whereby the seal is along the perimeter of the pouch.

The laminate described in this invention is sealed with a so-called fusion or strong seal around the product to be packaged, for instance a pharmaceutical tablet, thereby using as little volume as required by the size of the product. The seal is performed by the heat seal coating described earlier. The cold sealable or the low seal heat sealable portion with a coating that has a lower seal strength is sealed either cold or with the same temperature as used for the heat sealable coating. The seal is designed in order to leave an area for the consumer to peel-open this seal, and therefore does not necessarily cover all the outside perimeter of the pouch.

Furthermore, a perforation is made along the firm seal, with notches extending to the sides of the pouch. The firm seal is provided with a tear-notch in the middle of the seal, as described earlier.

The outside of the pouch is printed and the information or appearance is similar to existing pouches. The print that was applied to the other side of the pouch is visible by peeling the portion of the pouch that is either cold-sealed or that was sealed with the coating having a lower seal strength than coating. When peeling these two sides of the pouch apart, the inside printing is visible to the consumer. Particularly with the cold seal or pressure sensitive, these flaps can be reclosed and stuck together if the product is not to be consumed at that time.

With the invention pouches, the amount of print information available to the consumer without even opening the pouch has been increased significantly.

When the product is to be consumed, the user needs to fold the firm seal perpendicularly to the provided notch in the seal and tear the structure, as one would normally do with existing pouches. That feature, combined with the perforation along the firm seal provides the child-resistant feature to the package.

When peeling the two peelable sides of the pouch with the added printed information with force, once the peel-opening reaches the firm seal with the provided perforation, these now separated flaps will invariably tear away from the firmly sealed portion of the pouch, along the provided perforation.

If, a user, not aware or not capable of reading the printed information (such as a child) performs the same operation, the flaps will separate at the perforations, without allowing access to the product, and therefore providing a child resistant package. If the user or the child notices the notches at the edge of the pouch and applies shear force, the notches and the perforations will tear the flaps away from the firmly sealed compartment containing the product. That way, a child resistant package is provided as well. The only possible way to open the pouch is to fold the firm seal as described earlier and tear the pouch from there along the notch. This represents a high degree of resistance to child opening, while being extremely convenient for adult consumers and particularly for the geriatric population, because a lot of force or a high dexterity to perform the two opening steps is not required.

The fact that the tear notch required to open the pouch is now located further away from the edge of the pouch than with conventional pouches makes it easier for the geriatric population to perform the fold necessary to tear the pouch, because the area to grab to fold is significantly larger. This at the same time is a further hindrance for the small hands of a child to inadvertently perform the required movement leading to a possibility to tear the pouch. Also this notch is very difficult to access by biting, a preferred mode of opening packages for children. The overall bigger print surface also allows for larger fonts to be used for printing the regulatory information as well as the opening indications, which are further welcome help for the geriatric population.

High barrier means that the laminate has a low level of oxygen and moisture permeability, whereas medium barrier means that the laminate has a higher level of oxygen and moisture permeability.

Figure 8:
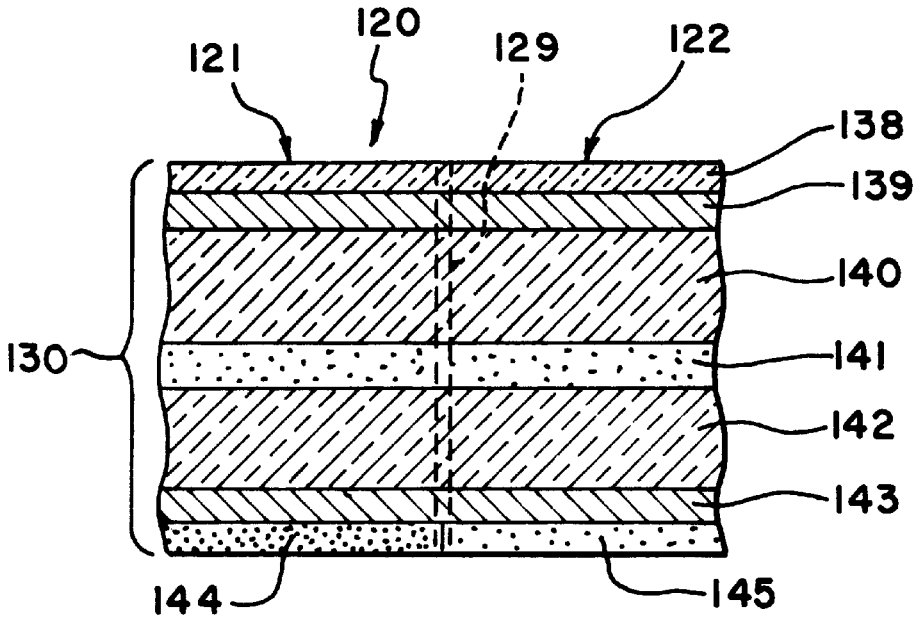
FIG. 8 is a partial cross-sectional side view of an embodiment of the top laminate.
Figure 9:
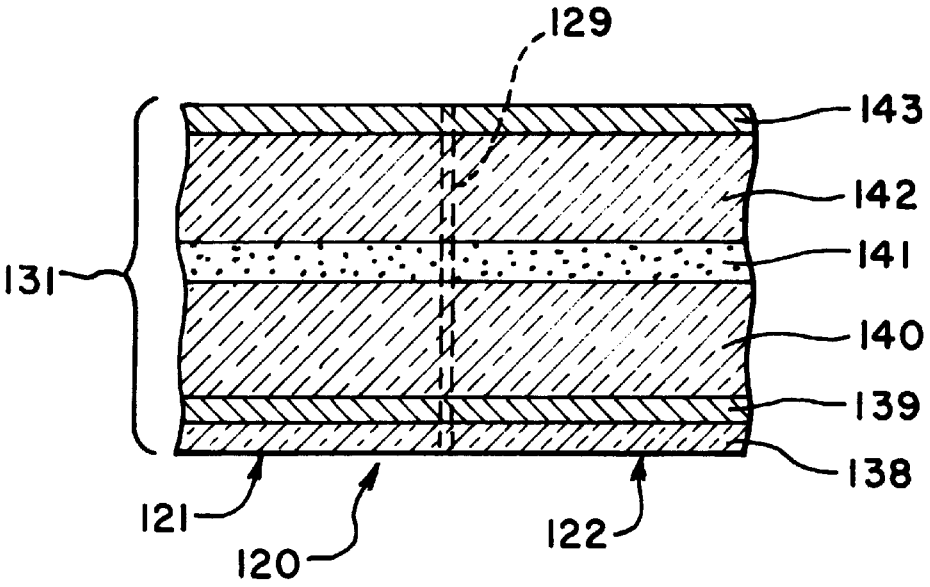
FIG. 9 is a partial cross-sectional side view of the bottom laminate of the embodiment of FIG. 9.

In FIGS. 8 and 9, a preferred embodiment of the invention is shown. The portion of pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 8, top laminate 130 is a high barrier transparent laminate and contains, from the outer surface to the inner surface thereof, respectively, (a) overprint varnish layer 138, (b) first ink printed layer 139, (c) polyester (preferably polyethylene terephthalate) layer 140, (d) adhesive layer 141, (e) Ceramis® polyester (preferably polyethylene terephthalate) layer 142, (f) second ink printed layer 143, and (g) numeral 144 represents the strongly adhered heat seal adhesive layer in pouch enclosure portion 121, and numeral 145 represents the weakly adhered sealable adhesive layer in flap portion 122. In FIG. 9, bottom laminate 131 is a high barrier, transparent laminate and contains, from the outer surface to the inner surface thereof, respectively, (h) overprint varnish layer 138, (i) first ink printed layer 139, (j) polyester (preferably polyethylene terephthalate) layer 140, (k) adhesive layer 141, (l) Ceramis® polyester (preferably polyethylene terephthalate) layer 142, and (m) second ink printed layer 143.

Figure 10:
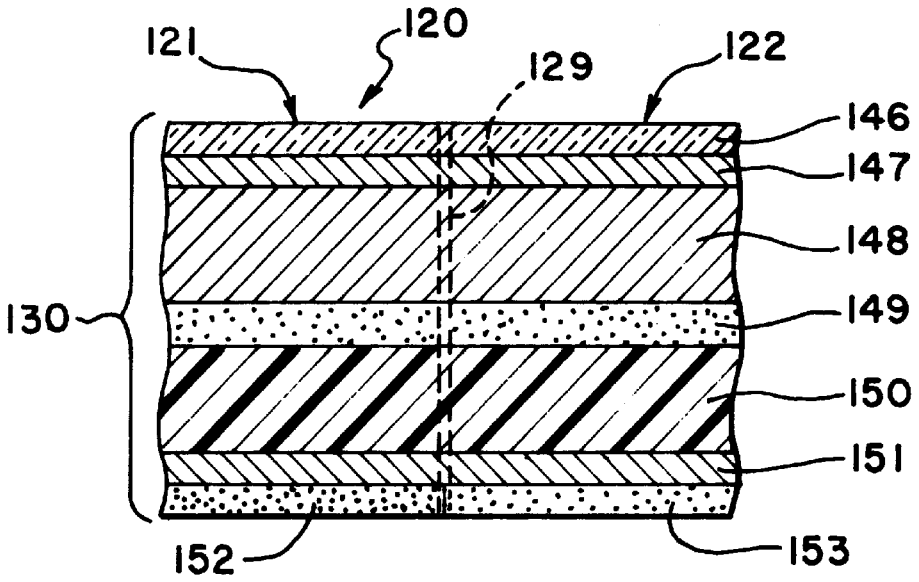
FIG. 10 is a partial cross-sectional side view of a further embodiment of the top laminate.
Figure 11:
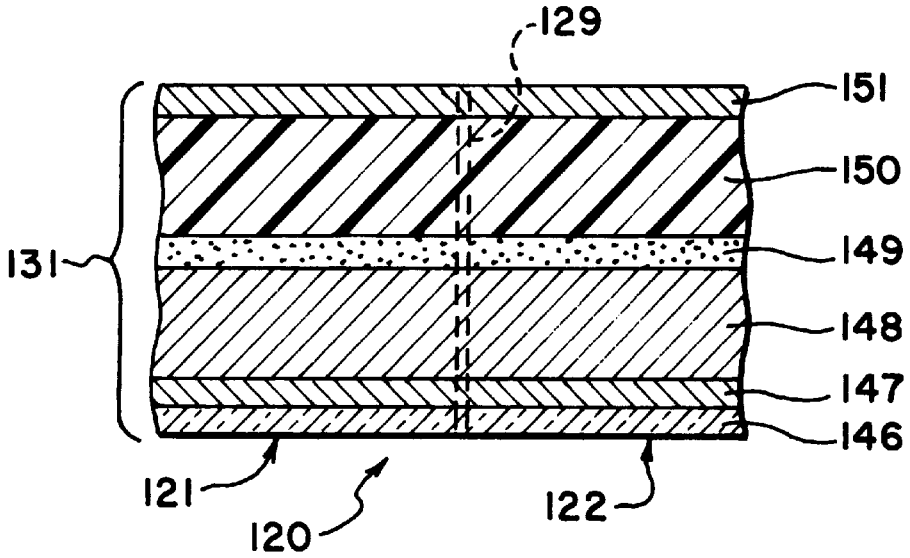
FIG. 11 is a partial cross-sectional side view of the bottom laminate of the embodiment of FIG. 10.

In FIGS. 10 and 11, another preferred embodiment of the invention is shown. The portion of pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 10, top laminate 130 is a high barrier, opaque laminate and contains, from the outer surface to the inner surface thereof, respectively, (a) overprint varnish layer 146, (b) first ink printed layer 147, (c) paper layer 148, (d) adhesive layer 149, (e) Ceramis® polyester (preferably polyethylene terephthalate) layer 150, (f) second ink printed layer 151, and (g) numeral 152 represents the strongly adhered heat seal adhesive layer in pouch enclosure portion 121, and numeral 153 represents the weakly adhered sealable adhesive layer in flap portion 122. In FIG. 11, bottom laminate 131 is a high barrier, opaque laminate and contains, from the outer surface to the inner surface thereof, respectively, (h) overprint varnish layer 146, (i) first ink printed layer 147, (j) paper layer 148, (k) adhesive layer 149, (l) Ceramis® polyester (preferably polyethylene terephthalate) layer 150, and (m) second ink printed layer 151.

Figure 12:
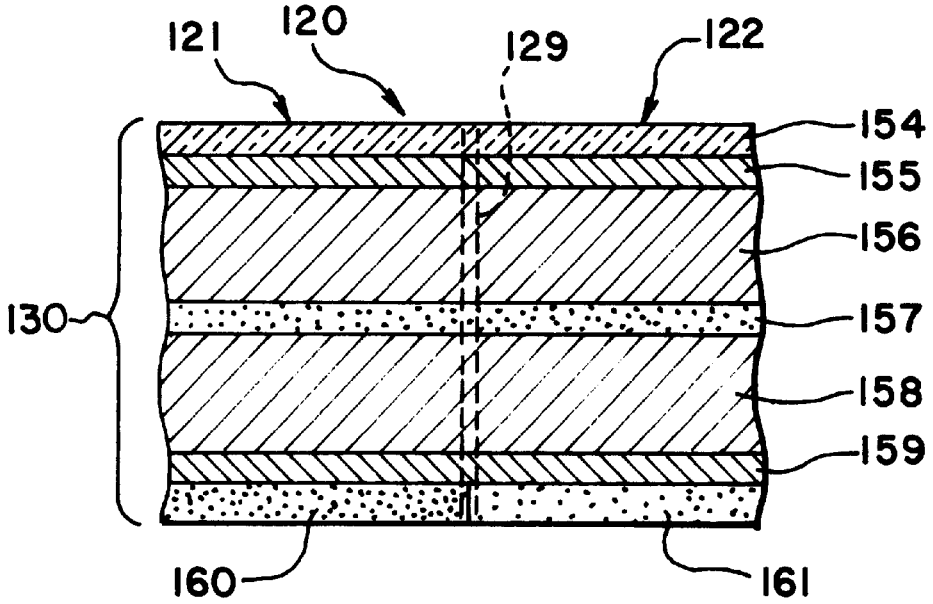
FIG. 12 is a partial cross-sectional side view of another embodiment of the top laminate.
Figure 13:
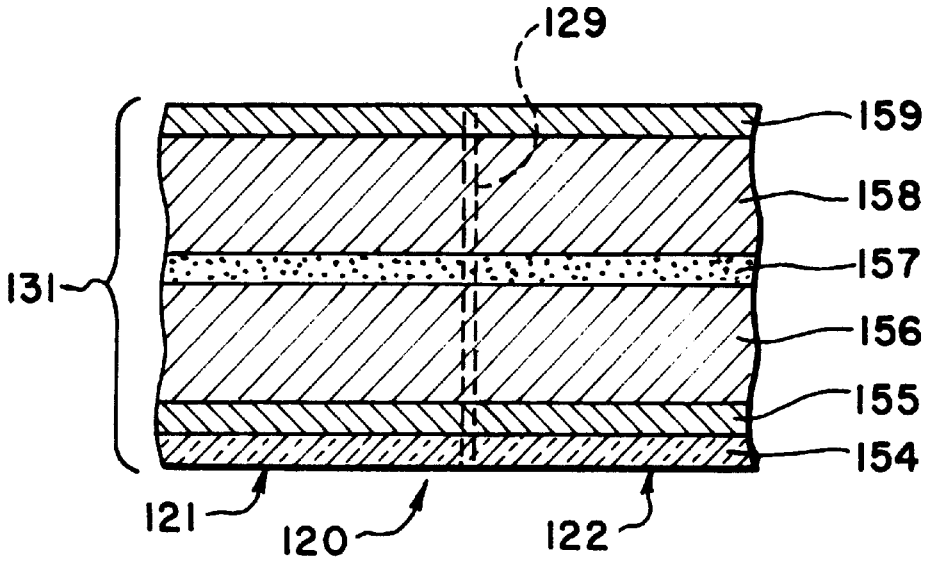
FIG. 13 is a partial cross-sectional side view of the bottom laminate of the embodiment of FIG. 12.

In FIGS. 12 and 13, another preferred embodiment of the invention is shown. The portion of pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 12, top laminate 130 is a medium barrier, opaque laminate and contains, from the outer surface to the inner surface thereof, respectively, (a) overprint varnish layer 154, (b) first ink printed layer 155, (c) paper layer 156, (d) adhesive layer 157, (e) metallized polyester (preferred) layer 158, (f) second ink printed layer 159, and (g) numeral 160 represents the strongly adhered heat seal adhesive layer in pouch enclosure portion 121, and numeral 161 represents the weakly adhered sealable adhesive layer in flap portion 122. In FIG. 13, bottom laminate 131 is a medium barrier, opaque laminate and contains, from the outer surface to the inner surface thereof, respectively, (h) overprint varnish layer 154, (i) first ink printed layer 155, 0) paper layer 156, (k) adhesive layer 157, (l) metallized polyester (preferred) layer 158, and (m) second ink printed layer 159. Layers 158 are particularly preferably Al metallized polyethylene terephthalate layers but can also be metallized polyolefin (preferably polyethylene, best high density polyethylene) layers.

Figure 14:
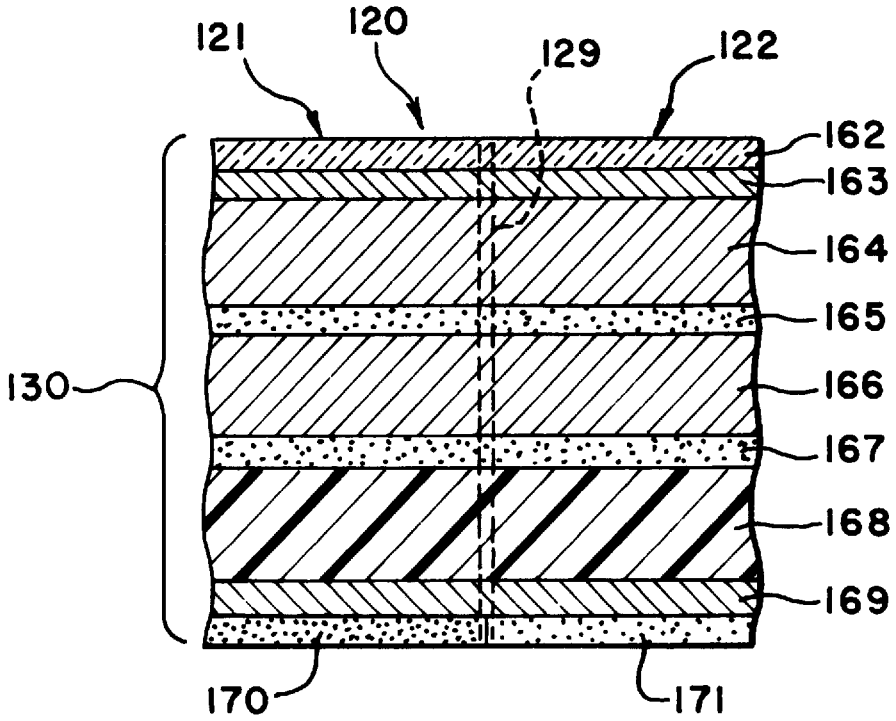
FIG. 14 is a partial cross-sectional side view of another embodiment of the top laminate.
Figure 15:
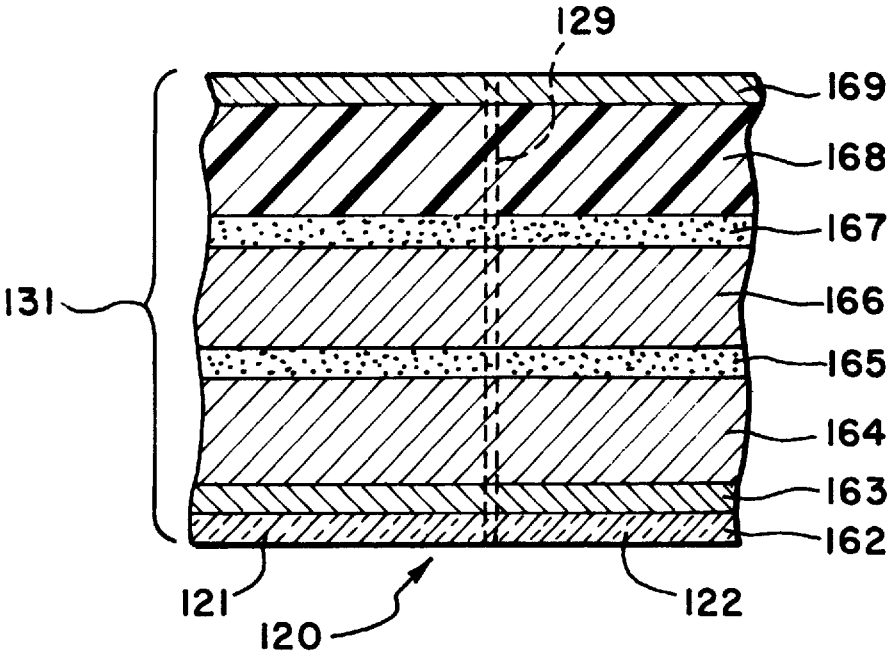
FIG. 15 is a partial cross-sectional side view of the bottom laminate of the embodiment of FIG. 14.

In FIGS. 14 and 15, another preferred embodiment of the invention is shown. The portion of pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 14, top laminate 130 contains, from the outer surface to the inner surface thereof, respectively, (a) overprint varnish layer 162, (b) first ink printed layer 163, (c) polyester (preferably polyethylene terephthalate) layer or paper layer 164, (d) first adhesive layer 165, (e) aluminum foil 166, (f) second adhesive layer 167, (g) polyethylene (preferably low density polyethylene) layer 168, (h) second ink printed layer 169, and (i) numeral 170 represents the strongly adhered heat seal adhesive layer in pouch enclosure portion 121, and numeral 171 represents the cold seal adhesive layer or the pressure sensitive adhesive layer or the weak heat sealable adhesive layer in flap portion 122. In FIG. 15, bottom laminate 131 contains, from the outer surface to the inner surface thereof, respectively, (j) overprint varnish layer 162, (k) first ink printed layer 163, (l) polyester (preferably polyethylene terephthalate) layer or paper layer 164, (m) first adhesive layer 165, (n) aluminum foil 166, (o) second adhesive layer 167, (p) polyethylene (preferably low density polyethylene) layer 168, and (q) second ink printed layer 169.

Figure 16:
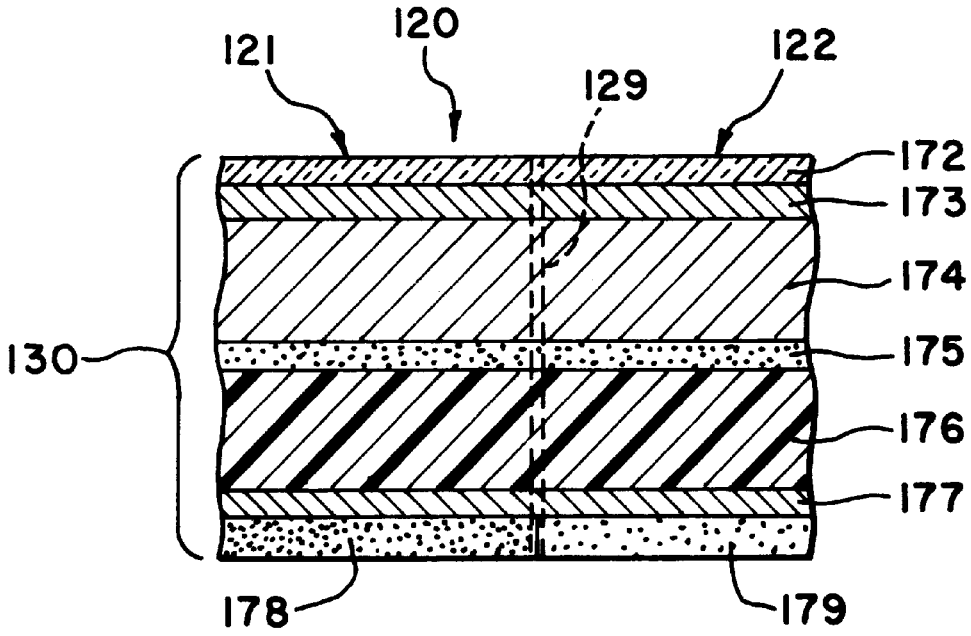
FIG. 16 is a partial cross-sectional side view of another embodiment of the top laminate.
Figure 17:
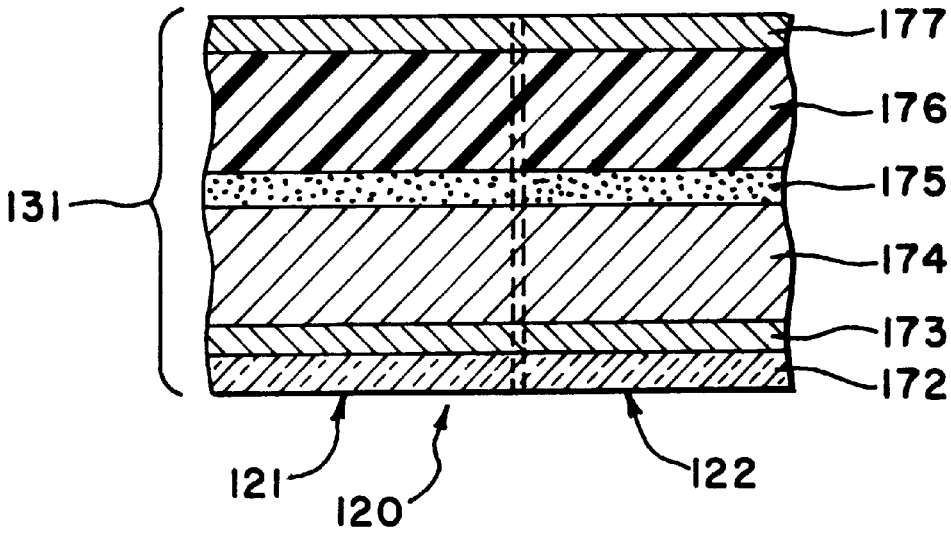
FIG. 17 is a partial cross-sectional side view of the bottom laminate of the embodiment of FIG. 16.

In FIGS. 16 and 17, another preferred embodiment of the invention is shown. The portion of pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 16, top laminate 133 contains, from the outer surface to the inner surface thereof, respectively, (a) overprint varnish layer 172, (b) first ink printed layer 173, (c) paper layer 174, (d) adhesive layer 175, (e) Ceramis® polyester (preferably polyethylene terephthalate) layer 176, (f) second ink printed layer 177, and (g) numeral 178 represents the strongly adhered heat seal adhesive layer in pouch enclosure portion 121, and numeral 179 represents the weakly adhered sealable adhesive layer in flap portion 122. In FIG. 17, bottom laminate 131 contains, from the outer surface to the inner surface thereof, respectively, (h) overprint varnish layer 172, (i) first ink printed layer 173, (j) paper layer 174, (k) adhesive layer 175, (l) Ceramis® polyester (preferably polyethylene terephthalate) layer 176, and (m) second ink printed layer 177.

Figure 18:
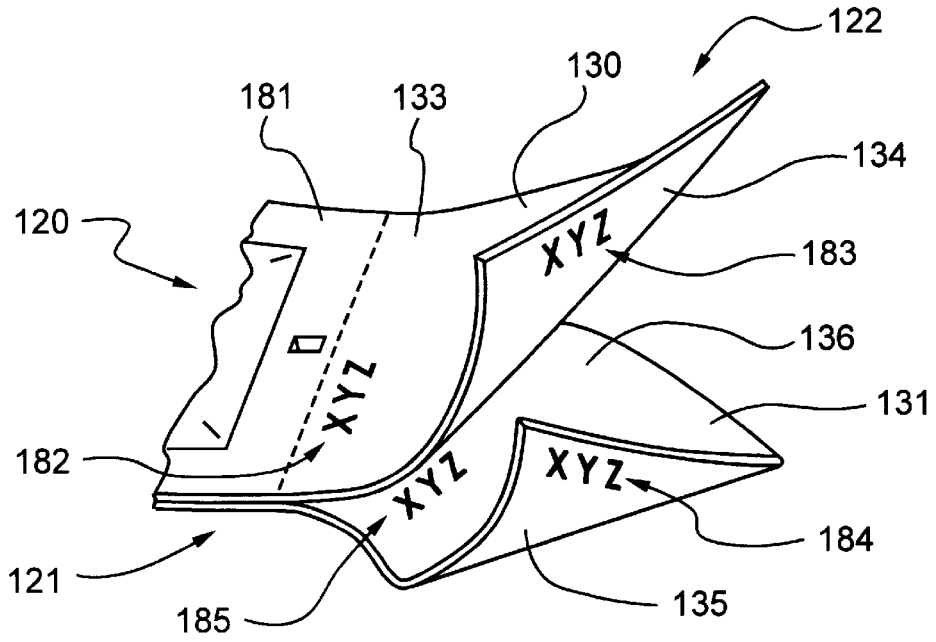
FIG. 18 is a partial perspective view of an embodiment of the invention with both flaps separated with printing on both surfaces of each.

In FIG. 18, top laminate 130 has printing 182 on its top surface 133 and printing 183 on its bottom surface 134, and bottom laminate 131 has printing 184 on its bottom surface 135 and printing 185 on its top surface 136.

Figure 19:
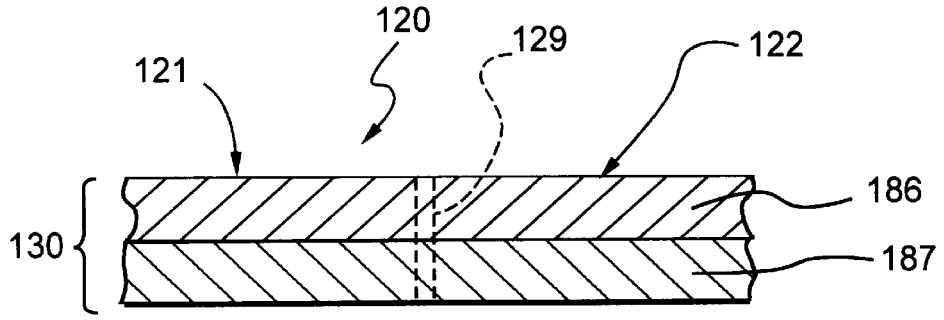
FIG. 19 is a partial cross-sectional side view of an embodiment of the top laminate.
Figure 20:
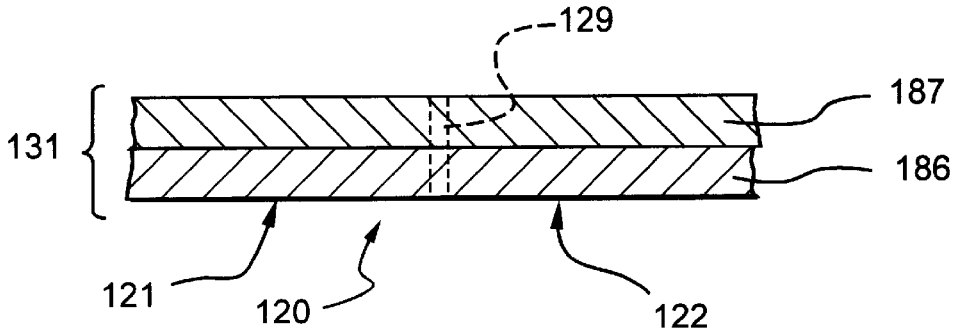
FIG. 20 is a partial cross-sectional side view of the bottom laminate of the embodiment of FIG. 19.

In FIG. 19 and 20, an embodiment of the invention is shown. The portion of the pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 19, top laminate 130 contains, from the outer surface to the inner surface thereof, respectively, polymeric film 186 and metal foil 187. In FIG. 20, bottom laminate 131 contains, from the outer surface to the inner surface, respectively, polymeric film 186 and metal foil 187.

Figure 21:
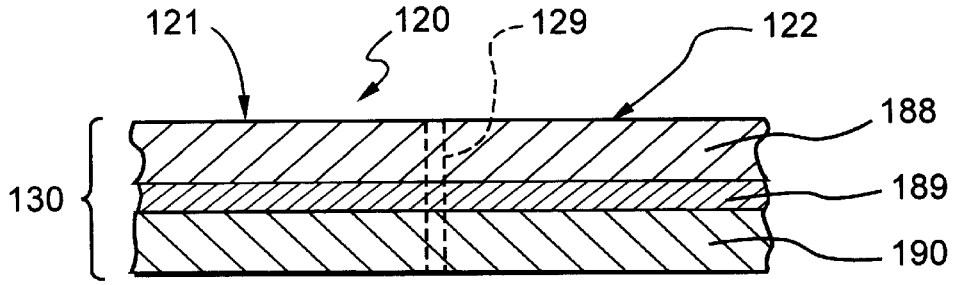
FIG. 21 is a partial cross-sectional side view of an embodiment of the top laminate.
Figure 22:
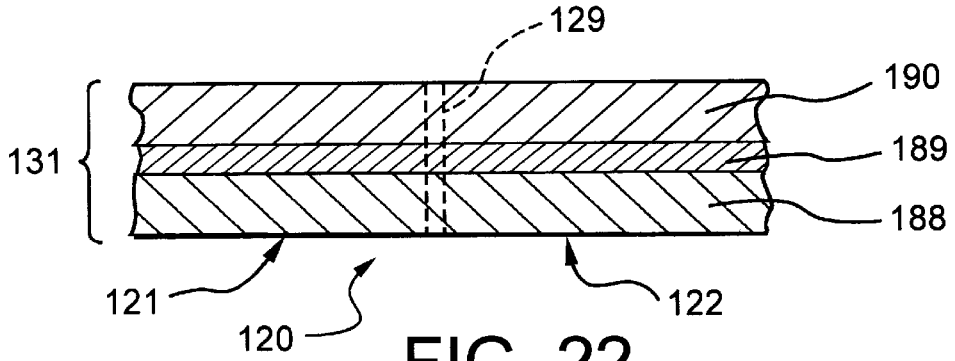
FIG. 22 is a partial cross-sectional side view of the bottom laminate of the embodiment of FIG. 21.

In FIG. 21 and 22, an embodiment of the invention is shown. The portion of the pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 21, top laminate 130 contains, from the outer surface to the inner surface thereof, respectively, first polymeric film 188, metal foil 189 and second polymeric film 190. In FIG. 22, bottom laminate 131 contains, from the outer surface to the inner surface, respectively, first polymeric film 188, metal foil 189 and second polymeric film 190.

Figure 23:
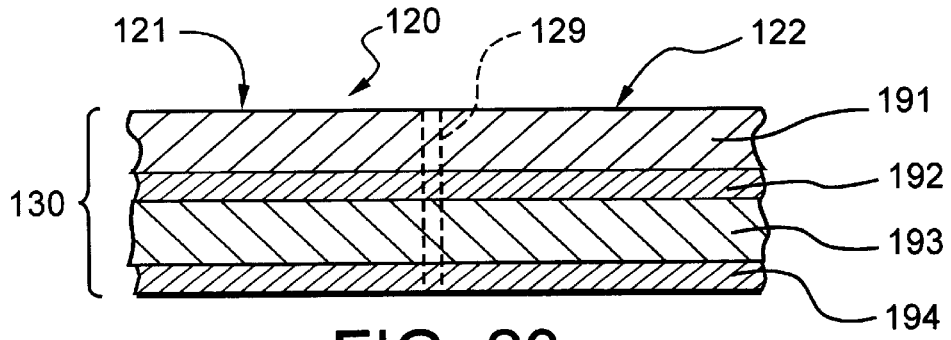
FIG. 23 is a partial cross-sectional side view of an embodiment of the top laminate.
Figure 24:
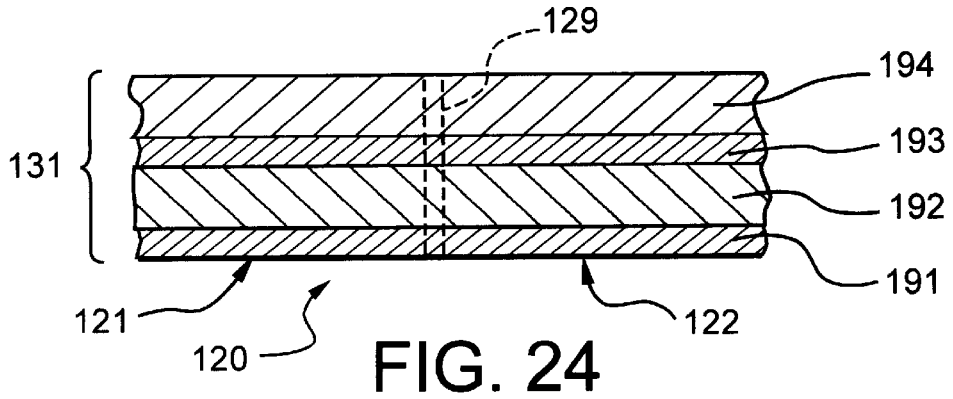
FIG. 24 is a partial cross-sectional side view of the bottom laminate of the embodiment of FIG. 23.

In FIG. 23 and 24, an embodiment of the invention is shown. The portion of the pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 23, top laminate 130 contains, from the outer surface to the inner surface thereof, respectively, first polymeric film 191, metal foil 192, second polymeric film 193 and sealable material layer 194. In FIG. 24, bottom laminate 131 contains, from the outer surface to the inner surface, respectively, first polymeric film 191, metal foil 192, second polymeric film 193 and sealable material layer 194.

Figure 25:
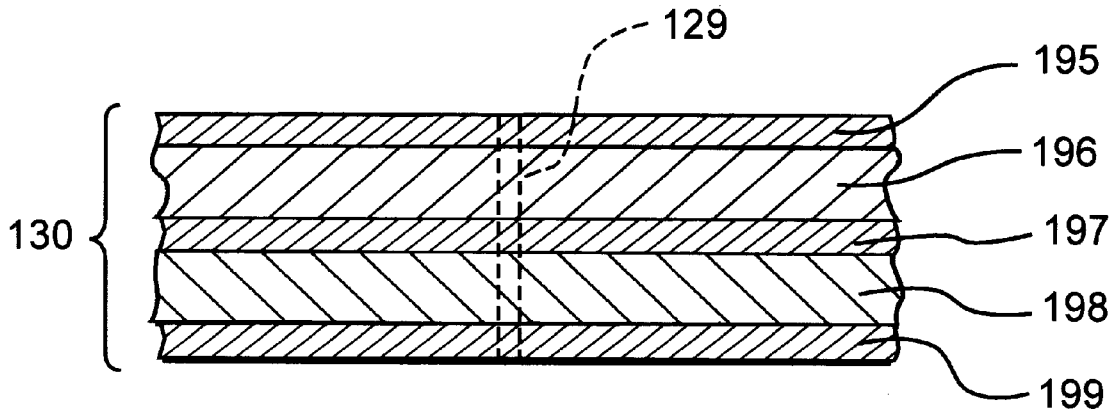
FIG. 25 is a partial cross-sectional side view of an embodiment of the top laminate.
Figure 26:
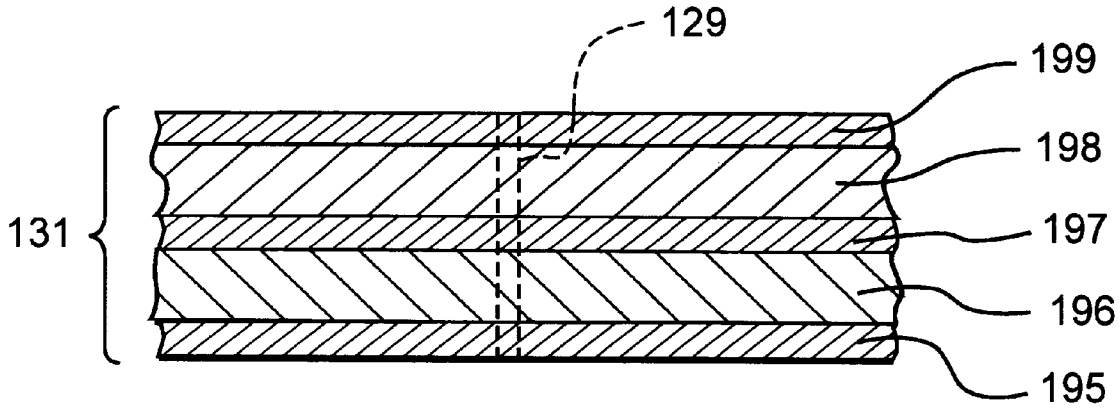
FIG. 26 is a partial cross-sectional side view of the bottom laminate of the embodiment of FIG. 25.

In FIG. 25 and 26, an embodiment of the invention is shown. The portion of the pouch 120 shown is the cross-section of top laminate 130 and bottom laminate 131, separately, at the interface region between pouch enclosure portion 121 and flap portion 122. The line of perforations at the interface of pouch enclosure portion 121 and flap portion 122 is represented by numeral 129. In FIG. 24, top laminate 130 contains, from the outer surface to the inner surface thereof, respectively, overlaquer layer 195, first polymeric film 199, metal foil 197, second polymeric film 198 and sealable material layer 199. In FIG. 25, bottom laminate 131 contains, from the outer surface to the inner surface, respectively, overlaquer layer 195, first polymeric film 196, metal foil 197, second polymeric film 198 and sealable material layer 199.

What is claimed is:

1. A pouch for a product, comprising a structure comprising a top laminate and a bottom laminate, a pouch enclosure for a product being formed in one portion of said structure, the top laminate and the bottom laminate of the pouch enclosure being strongly adhered together in the periphery around the pouch enclosure, a flap portion being formed by the remainder of said structure with a portion of the top laminate and a portion of the bottom laminate being weakly adhered together and being easily pulled apart, means for facilitating the separation of the flap portion and the pouch enclosure being situated at the interface between the flap portion and the pouch enclosure, a hole being located in the strongly adhered periphery of the pouch enclosure adjacent to the flap portion, at least one side of at least one member of the group consisting of the top laminate and the bottom laminate being capable of being printed on.

2. The pouch as claimed in claim 1 wherein printing is visibly contained on the inside and outside surfaces of both of the top laminate region and the bottom laminate region of the flap portion.

3. The pouch as claimed in claim 1 wherein the means for separating the flap portion from the pouch enclosure comprises a line of perforations aligned along the intersection of the flap portion and the pouch enclosure.

4. The pouch as claimed in claim 3 wherein, when the top and bottom laminate regions of the flap portion have been separated from each other, the top and bottom laminate regions can each individually be separated from the pouch portion.

5. The pouch as claimed in claim 3 wherein a notch is located on each end of the line of perforations and aligned on the longitudinal axis of the line of perforations.

6. The pouch as claimed in claim 1 wherein the means for separating the flap portion from the pouch enclosure comprises a groove located in at least one member of the group consisting of outer surface of the top laminate and outer surface of the bottom laminate, and aligned along the intersection of the flap portion and the pouch enclosure.

7. The pouch as claimed in claim 6 wherein a notch is located on each end of the groove line and aligned on the longitudinal axis of the groove or grooves.

8. The pouch as claimed in claim 1 wherein the hole is a slot, the longitudinal axis of the slot in the strongly adhered periphery of the pouch enclosure being aligned between 45 and 90 degrees to the intersection between the pouch enclosure and the flap portion.

9. The pouch as claimed in claim 8 wherein the periphery of the pouch enclosure adjacent to the flap portion is wider than the other parts of said periphery.

10. The pouch as claimed in claim 9 wherein the longitudinal axis of said slot is perpendicular to the intersection between the pouch enclosure and the flap portion.

11. The pouch as claimed in claim 1 wherein the top laminate contains, from the outer surface to the inner surface thereof, respectively:

(a) an overprint varnish layer, (b) a first ink printed layer, (c) a polyester layer or a paper layer, (d) a first adhesive layer, (e) a metal foil, (f) a second adhesive layer, (g) a polyolefin layer, (h) a second ink printed layer, (i) a strongly adhered heat seal adhesive layer in the pouch enclosure, and a cold seal adhesive layer or a pressure sensitive adhesive layer or a peelable sealing adhesive layer or a weak heat sealable adhesive layer in the flap portion, and the bottom laminate contains, from the outer surface to the inner surface thereof, respectively:

(j) an overprint varnish layer, (k) a first ink printed layer, (l) a polyester layer or a paper layer, (m) a first adhesive layer, (n) a metal foil, (o) a second adhesive layer, (p) a polyolefin layer, (q) a second ink printed layer.

12. The pouch as claimed in claim 1 wherein the top laminate contains, from the outer surface to the inner surface thereof, respectively:

(a) an overprint varnish layer, (b) a first ink printed layer, (c) a paper layer, (d) an adhesive layer, (e) a silicon oxide coated polyester layer, (f) a second ink printed layer, (g) a strongly adhered heat seal adhesive layer in the pouch enclosure, and a cold seal adhesive layer or a pressure sensitive adhesive layer or a peelable sealing adhesive layer or a weakly adhered heat sealable adhesive layer in the flap portion, and the bottom laminate contains, from the outer surface to the inner surface thereof, respectively:

(h) an overprint varnish layer, (i) a first printed layer, (j) a paper layer, (k) an adhesive layer, (l) a silicon oxide coated polyester layer, (m) a second ink printed layer.

13. The pouch as claimed in claim 1 wherein the top laminate is transparent and contains, from the outer surface to the inner surface thereof, respectively:

(a) an overprint varnish layer, (b) a first ink printed layer, (c) a polyester layer, (d) an adhesive layer, (e) a silicon oxide coated polyester layer, (f) a second ink printed layer, (g) a strongly adhered heat seal adhesive layer in the pouch enclosure, and a weakly adhered sealable adhesive layer in the flap portion, and the bottom laminate contains, from the outer surface to the inner surface thereof, respectively:

(h) an overprint varnish layer, (i) a first ink printed layer, (j) a polyester layer, (k) an adhesive layer, (l) a silicon oxide coated polyester layer, (m) a second ink printed layer.

14. The pouch as claimed in claim 1 wherein the top laminate is opaque and contains, from the outer surface to the inner surface thereof, respectively:

(a) an overprint varnish layer, (b) a first ink printed layer, (c) a paper layer, (d) an adhesive layer, (e) a silicon oxide coated polyester layer or a metallized polyester layer, (f) a second ink printed layer, (g) a strongly adhered heat seal adhesive layer in the pouch enclosure, and a weakly adhered sealable adhesive layer in the flap portion, and the bottom layer contains, from the outer surface to the inner surface thereof, respectively:

(h) an overprint varnish layer, (i) a first ink printed layer, (j) a paper layer, (k) an adhesive layer, (l) a silicon oxide coated polyester layer or a metallized polyester layer, (m) a second ink printed layer.

15. The pouch as claimed in claim 1 wherein each of the top laminate and the bottom laminate comprises the structure of a polymeric film and a metal foil.

16. The pouch as claimed in claim 1 wherein each of the top laminate and the bottom laminate comprises the structure of a first polymeric film, a metal foil and a second polymeric film.

17. The pouch as claimed in claim 16 wherein the top laminate has a layer of a sealable material which is located side of said second polymeric film opposite of said metal film.

18. The pouch as claimed in claim 17 wherein, for each of the top laminate and the bottom laminate, a layer of an overlacquer, which is a heat release overlacquer or a release overlacquer, is located on side of said first polymeric film opposite of said metal film.

19. The pouch as claimed in claim 1 wherein each of the top laminate and the bottom laminate comprises the structure of (a) at least one polymeric film, (b) a metal foil and (c) at least one polymeric film.

20. A pouch for a product, comprising: a structure comprising:

(a) a pouch enclosure comprising a top laminate and a bottom laminate, the periphery of pouch portion comprising the periphery of the top laminate and the periphery of the bottom laminate being strongly adhered together by means of a heat sealed adhesive layer, at least one of the center region of the top laminate extended and the center region of the bottom laminate being outwardly extended, thereby forming a pouch enclosure wherein a product can be contained; and (b) a flap portion which is contiguous with the pouch enclosure, the flap portion comprising a contiguous extension of said top laminate and a contiguous extension of said bottom laminate, said contiguous extensions of said top and bottom laminates are weakly adhered together over a portion of inner surfaces of said contiguous extensions of said top and bottom laminates by means of a peelable adhesive coating, sealing a pressure sensitive coating material, a cold seal adhesive coating, or a weak heat sealable adhesive coating, a line of perforations being aligned along the intersection between the pouch enclosure and the flap portion, a notch being located on each end of the line on the longitudinal axis of the line of perforations, a hole being located in the strongly adhered periphery of the pouch enclosure adjacent to the flap portion, the hole being aligned perpendicular to the line of perforations and not contacting the line of perforations.

* * * * *